US007231977B2

(12) United States Patent
Keller

(10) Patent No.: US 7,231,977 B2
(45) Date of Patent: Jun. 19, 2007

(54) CONTINUOUS MONOBORE LIQUID LINING SYSTEM

(75) Inventor: Stuart R. Keller, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/560,003

(22) PCT Filed: May 27, 2004

(86) PCT No.: PCT/US2004/016665

§ 371 (c)(1),
(2), (4) Date: Dec. 8, 2005

(87) PCT Pub. No.: WO2005/017300

PCT Pub. Date: Feb. 24, 2005

(65) Prior Publication Data

US 2006/0196663 A1 Sep. 7, 2006

Related U.S. Application Data

(60) Provisional application No. 60/489,986, filed on Jul. 25, 2003.

(51) Int. Cl.
*E21B 33/138* (2006.01)

(52) U.S. Cl. ..... 166/292; 166/285; 166/287

(58) Field of Classification Search ..... 166/285, 166/287, 292

See application file for complete search history.

(56) References Cited

U.S. PATENT DOCUMENTS

| | | | | |
|---|---|---|---|---|
| 2,080,406 | A | 5/1937 | Allen | 166/287 |
| 4,099,583 | A | 7/1978 | Maus | 175/7 |
| 4,759,408 | A | 7/1988 | Buchanan | 166/278 |
| 4,784,223 | A | 11/1988 | Worrall et al. | 166/287 |
| 5,842,518 | A | 12/1998 | Soybel et al. | 166/287 |
| 6,183,166 | B1 | 2/2001 | Schellhorn | 405/233 |
| 6,497,289 | B1 | 12/2002 | Cook et al. | 166/380 |
| 2004/0108141 | A1 | 6/2004 | Reddy et al. | 175/65 |
| 2004/0118574 | A1 | 6/2004 | Cook et al. | 166/384 |

FOREIGN PATENT DOCUMENTS

| | | |
|---|---|---|
| EP | 0346961 | 12/1989 |
| EP | 0403025 | 12/1990 |
| EP | 1217166 | 6/2002 |
| EP | 1300545 | 4/2003 |
| WO | WO01/98627 | 12/2001 |

OTHER PUBLICATIONS

Dallaire, et al. (1998) "High-Performance Powder," Energy Resources, Jan. 1998, pp. 49-51.

Dupal, et al (2001) "Solid Expandable Tubular Technology—A Year of Case Histories in the Drilling Environment," SPE/IADC Drilling Conference held in Amsterdam, The Netherlands, SPE/IADC 67770.

O'Neil, et al., (2001) "Tensile Properties of Very-High-Strength Concrete for Penetration-Resistant Structures," *US Army Engineer Research and Development Center*, 3909 Halls Ferry Road, Vicksburg, MS.

EP Search Report No. RS 110295 US, dated Jan. 21, 2004, 2 pages.

PCT International Search Report & Written Opinion dated Jul. 6, 2005, 6 pages.

*Primary Examiner*—Jennifer H. Gay
*Assistant Examiner*—Giovanna M Collins

(57) ABSTRACT

A process for drilling a well or a portion of a well capable of providing a generally constant interior wall diameter (monobore) and does not require installation of any liner or steel casing. The process comprises circulating settable material into the borehole wherein the settable material sets on at least a portion of the interior wall of the borehole to create a liner along the wall of the borehole and removing excess settable material out of the borehole.

5 Claims, 3 Drawing Sheets

CONTINUOUS MONOBORE LIQUID LINING SYSTEM

FIELD OF THE INVENTION

This patent generally relates to subterranean boreholes. More particularly, this patent relates to a method for lining the borehole.

BACKGROUND

Conventionally, when a wellbore is created, a number of casings are installed in the borehole to prevent collapse of the borehole wall and to prevent undesired outflow of drilling fluid into the formation or inflow of fluid from the formation into the borehole. The borehole is typically drilled in intervals whereby a casing (such as, steel pipe), which is to be installed in a lower borehole interval, is lowered through a previously installed casing of an upper borehole interval. As a consequence of this procedure, the casing of the lower interval is of smaller diameter than the casing of the upper interval. Thus, the casings are in a nested arrangement with casing diameters decreasing in the downward direction. Cement annuli are provided between the outer surfaces of the casings and the borehole wall to seal the casings from the borehole wall.

As a consequence of this nested arrangement, relatively large borehole diameters are required in the upper part of the wellbore. Such large borehole diameters involve increased costs due to the time to drill the holes, the time to install all of the casings, costs of casing, drilling fluid consumption. Moreover, increased drilling rig time and costs are involved due to required cement pumping, cement hardening, required equipment changes due to variations in hole diameters drilled in the course of the well, and the large volume of cuttings drilled and removed.

In most wells, the most critical role of the casing/cementing system is to increase the minimum fracture gradient to enable continued drilling. Generally, when drilling a well, the pore pressure gradient (PPG) and the fracture pressure gradient (FG) increase with the true vertical depth (TVD) of the well. For each drilling interval, a mud density (mud weight or MW) is used that is greater than the pore pressure gradient, but less than the fracture pressure gradient. As the well is deepened, the mud weight is increased to maintain a safe margin above the pore pressure gradient. If the mud weight were to fall below the pore pressure gradient, the well may take a kick. A kick is an influx of formation fluid into the wellbore. Kicks can result in dangerous situations and extra well costs to regain control of the well. If the mud weight is increased too much, the mud weight will exceed the fracture pressure gradient at the top of the drilling interval (usually this is the location with the smallest fracture pressure gradient). This normally leads to lost returns. Typically, lost returns occurs when the drilling fluid flows into a fracture (or other opening) created in the formation. Lost returns results in the cuttings not being removed from the wellbore. The cuttings may then accumulate around the drill string causing the drill string to become stuck. Stuck drill pipe is a difficult and costly problem that often results in abandoning the interval or the entire well.

To prevent the above situation from occurring, conventional practice typically involves running and cementing a steel casing string in the well. The casing and cement serve to block the pathway for the mud pressure to be applied to the earth above the depth of the casing shoe. This allows the mud weight to be increased so that the next drilling interval can be drilled. This process is generally repeated using decreasing bit and casing sizes until the well reaches the planned depth. The process of tripping, running casing, and cementing may account for as much as 25 to 65 percent of the time required for drilling a well. Tripping is the process of pulling the drill pipe or running the drill pipe into the well. This is important, because well costs are primarily driven by the rig time required to construct the well. Furthermore, with the conventional steel casing tapered-hole-drilling process, the final hole size that is achieved may not be useable or optimal and the casing and cement operations substantially increase well costs.

For exploration wells, the reduction in hole size with increasing depth may result in not reaching the planned target depth or not reaching the planned target depth with enough hole size to run logging tools to fully evaluate the formation. Typically, at least a 0.1524 meter (6-inch) open hole is needed to fully evaluate the formation. For some wells, the need to set casing to accommodate pore pressure/frac gradient concerns results in running out of hole size. For development wells, the telescopic nature of the well reduces the final hole size in the reservoir. This reduction in contact of the well with the reservoir may reduce the production rate of the well, thereby, reducing the well's performance. Generally, a larger hole size in the reservoir increases the well's production rate for a given drawdown. Drawdown is the difference between the fluid pressure in the reservoir and inside the well.

Current technology to address the problems discussed above include the use of solid expandable liners (SELs). An example of a solid expandable liner is disclosed in U.S. Pat. No. 6,497,289. Solid expandable liners are special tubular systems that are run into a well and then expanded. The expansion allows the open hole to be lined using a string that has a larger interior diameter than would otherwise be available with a conventional liner. The solid expandable liner system allows a larger bit and/or additional casing strings to be run in the well. This facilitates penetrating the reservoir with a larger hole size in development wells. For exploration wells, having one or two additional liners may enable the well to reach a planned target or deeper with a useable hole size.

While a solid expandable liner may be beneficial, it has several drawbacks. These include time and cost, connections, hole quality requirements, tapering, and cementing. Some of the drawbacks of solid expandable liners are summarized in the following paragraphs.

The process of installing a solid expandable liner takes longer than a conventional liner. This is because solid expandable liners must be expanded. Also, installing a solid expandable liner may require considerable time because the string must be run into the well very slowly due to the surge pressure created by the small-clearance expansion cone assembly. The additional time, as well as the direct cost of the solid expandable liner, makes solid expandable liners much more costly than a conventional liner.

A solid expandable liner uses special connections that are expanded along with the pipe body. The expansion may reduce the sealing and/or tensile capacity of the connections. At least one example of failure of a solid expandable liner connector has been documented in "Solid Expandable Tubular Technology—A Year of Case Histories in the Drilling Environment," Dupal, et al., SPE/IADC Drilling Conference held in Amsterdam, The Netherlands, 27 Feb.–1 Mar. 2001, Paper SPE/IADC 67770.

If the hole is not straight, but contains doglegs (kinks) or other imperfections, or if the solid expandable liner is differentially stuck, the expansion cone may become stuck. An example of this type of problem has also been documented in "Solid Expandable Tubular Technology—A Year of Case Histories in the Drilling Environment," Dupal, et al., SPE/IADC Drilling Conference held in Amsterdam, The Netherlands, 27 Feb.–1 Mar. 2001, Paper SPE/IADC 67770.

The currently available solid expandable liner system still results in a tapered wellbore. This is a fundamental problem because the expansion cone carrier assembly must pass through the previous liner.

With currently available solid expandable liners, the cement is placed around the liner or casing prior to expansion. If there is a malfunction during expansion, it is unlikely that the liner could be removed from the well for repair or replacement.

Another approach to mitigate the problem of having to periodically run casing, especially in deepwater wells, is to use a dual (or multiple) gradient drilling system. For example, U.S. Pat. No. 4,099,583 discloses a dual gradient drilling system. In this method, a lighter fluid is injected into the mud return annulus (typically in the riser) or other pathway to reduce the mud density from the injection point upwards. This helps tailor the mud pressure gradient profile to closer match the desired pressure gradient profile that is between the pore pressure gradient and fracture gradient profiles. Multiple gradient drilling systems may reduce the required number of casing strings by possibly one or two. However, these systems are mechanically complex, are very costly to implement, create operational concerns (for example, for well control), and still result in a tapered wellbore.

A "method for centrifugally forming a subterranean soil-cement casing" is disclosed in U.S. Pat. No. 6,183,166. In this method, a soil-processing tool is advanced and rotated into the earth while high velocity cement slurry is introduced to mix with the soil. As the device is withdrawn, the tool is rotated at a speed to exert a centrifugal force on the soil-cement mixture, causing the mixture to form a soil-cement casing at the outer region of the hole. Unfortunately, drawbacks to this soil-cement casing technique include that the soil-cement casing is weak and this technique does not avoid tapering.

Accordingly, there is a need for an improved system to install casings or linings inside wellbores that addresses the above-mentioned drawbacks of current casing techniques. This invention satisfies that need.

SUMMARY

One embodiment of the invention includes a method for creating a liner in a borehole located in a subterranean formation the borehole having an interior wall is disclosed. In this embodiment the method comprises two steps. The two steps are circulating settable material into the borehole wherein the settable material sets on at least a portion of the interior wall of the borehole to create a liner along the wall of the borehole and removing excess settable material out of the borehole before the settable material has completely set.

A second embodiment for creating a liner in a borehole located in a subterranean formation the borehole having an interior wall is also disclosed. This embodiment may include four steps. The four steps are (a) drilling a borehole (with a drill bit on a drill string), (b) placing settable material into an annulus within the wellbore to a desired fill height wherein the settable material sets on at least a portion of the interior wall of the borehole to create a liner along the wall of the borehole, (c) moving the drill string to prevent the settable material from setting, and (d) circulating drilling mud that may contain a set retarder to remove the unset settable material near the drill string.

A third embodiment for creating a liner in a borehole located in a subterranean formation the borehole having an interior wall is also disclosed. This embodiment may include three steps. The three steps are (a) providing a sacrificial liner inside the borehole to create an annular space between the sacrificial liner and the interior wall of the borehole, (b) circulating settable material into the borehole outside the sacrificial liner wherein the settable material will settle between the sacrificial liner and the interior wall of the borehole to create a liner between the sacrificial liner and interior wall of the borehole, and (c) drilling out the liner and sacrificial liner to create the borehole liner wherein the borehole liner has a hollow core inside the wellbore.

BRIEF DESCRIPTION OF THE DRAWINGS

FIG. 4(*b*) is one exemplary illustration of placing settable material in a wellbore;

FIG. 4(*c*) is one exemplary illustration of resuming drilling after the monobore cast-in-place liner is set;

FIG. 5(*b*) is one exemplary illustration of installing a sacrificial liner in a wellbore;

FIG. 5(*c*) is one illustration of placement of settable material around a sacrificial liner.

FIG. 5(*d*) is one illustration of drilling out a monobore cast-in-place liner in a wellbore;

FIG. 5(*e*) is one illustration of resuming drilling beneath an installed monobore cast-in-place liner.

DETAILED DESCRIPTION

Figure 1:
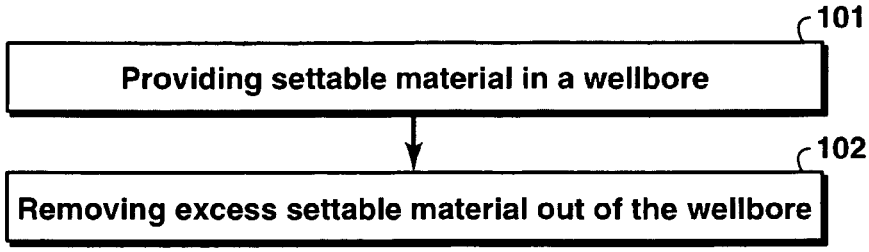
FIG. 1 is a flow chart of an embodiment of the present invention.

In the following detailed description and example, the invention will be described in connection with its preferred embodiments. However, to the extent that the following description is specific to a particular embodiment or a particular use of the invention, this is intended to be illustrative only. Accordingly, the invention is not limited to the specific embodiments described below, but rather, the invention includes all alternatives, modifications, and equivalents falling within the true scope of the appended claims.

The proposed invention includes a process for drilling a well or a portion of a well that may have a generally constant interior wall diameter (monobore) and does not require installation of any preformed liner or casing. An existing borehole may be provided or a new borehole may be drilled below an existing liner or casing string and then reamed to a larger hole size. This could be done using a standard bit and a remotely extendable/retractable reamer device located in the drill string bottomhole assembly.

Reamers are devices than can enlarge a borehole to a diameter greater than the interior wall diameter of a previously set casing or liner and still be withdrawn from the well. Alternatively, a bicenter bit could be used to drill a hole size larger than the interior wall diameter of the previous casing.

After the reamed hole is drilled, a special settable material (or liquid lining) is pumped into the borehole. Using a variety of techniques (which are discussed below), a hole is created or available in the center of the settable material such that the hole has preferably the same interior diameter as the existing casing string or liner. The hole creates a cast-in-place hollow cylindrical mono-inner-diameter lining for the borehole. The process is then repeated until the well reaches the desired total depth.

The process may use a pumpable hardening material (settable material) that lines the borehole. This material may be high-strength cement containing steel and/or carbon fibers. The fibers are known by those skilled in the art to greatly increase the flexural/tensile (and thus burst) capacity of such a settable material. For example, it has been shown that a concrete formulation containing about 2 percent by volume high-strength steel micro-fibers 13 mm in length and 0.16 mm in diameter are capable of increasing the flexural toughness to greater than 250 times that of conventional, non-fiber-reinforced concrete. See "Tensile Properties of Very-High-Strength Concrete for Penetration-Resistant Structures," O,Neil, et al., US Army Engineer Research and Development Center, 3909 Halls Ferry Road, Vicksburg, Miss. 39180-6199, 13 Apr. 2001 or "High-Performance Powder," Dallaire, et al., Energy Resources, January 1998, pp 49–51. The settable material might also be a resin-based material containing fibers. The back up (radial support) provided by the surrounding subterranean earth also increases the burst capacity of the settable liner. In addition, solids and other material that are present in drilling fluid will seal small cracks that might appear in the settable material.

In one embodiment, as described in FIG. 1, the method includes two steps. First, a settable material is circulated in the borehole (step 101). Next, the excess settable material is removed out of the borehole before the wellbore is plugged with settable material that has set (step 102). The remaining settable material inside the borehole creates a cast-in-place liner along the wall of the borehole. This embodiment will be discussed in more detail below.

Figure 2:
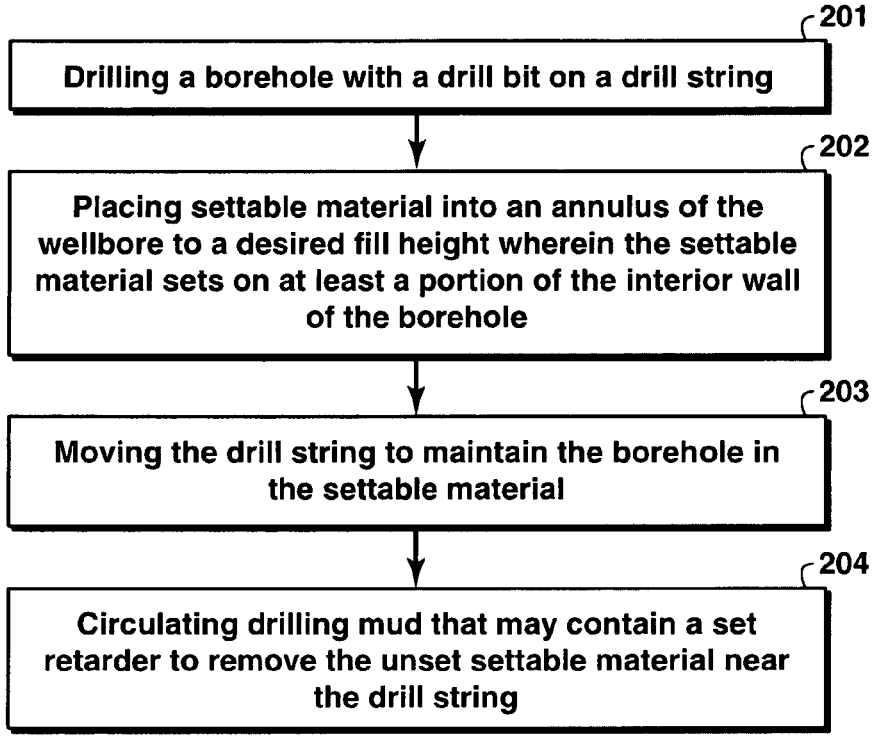
FIG. 2 is a flow chart of an embodiment of the present invention.

A second embodiment for creating a liner in a borehole located in a subterranean formation the borehole having an interior wall may include four steps. As described in FIG. 2, the four steps are (a) drilling a borehole with a drill bit on a drill string (step 201), (b) placing settable material into an annulus of the wellbore to a desired fill height wherein the settable material sets on at least a portion of the interior wall of the borehole to create a liner along the wall of the borehole (step 202), (c) moving the drill string to prevent the settable material from completely plugging the borehole (step 203), and (d) circulating drilling mud that may contain a set retarder to remove the unset settable material near the drill string (step 204).

Figure 4C:
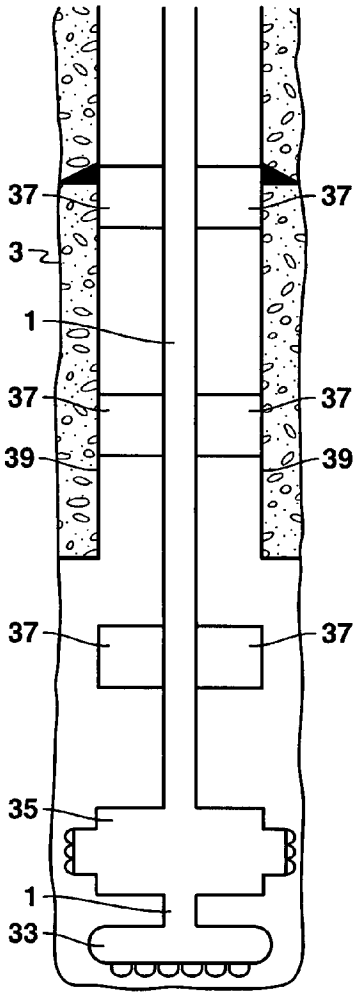
FIG. 4(*a*) is one exemplary illustration of a drilling and reaming operation in a wellbore.
Figure 4B:
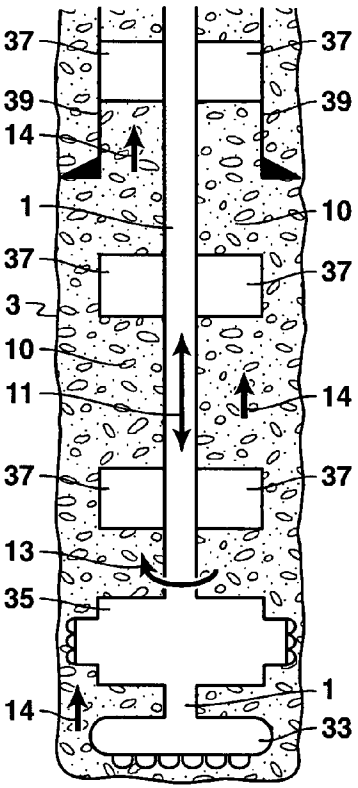
Figure 4A:
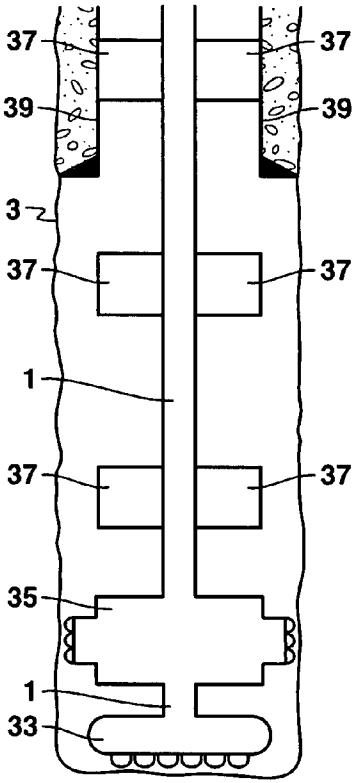
Figure 5E:
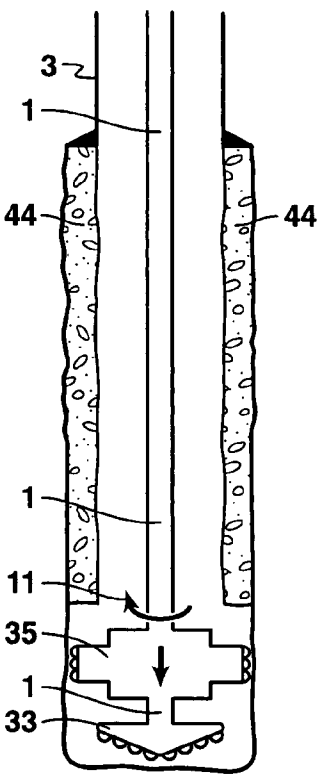
FIG. 5(*a*) is one exemplary illustration of a drilling and reaming operation in a wellbore.
Figure 5D:
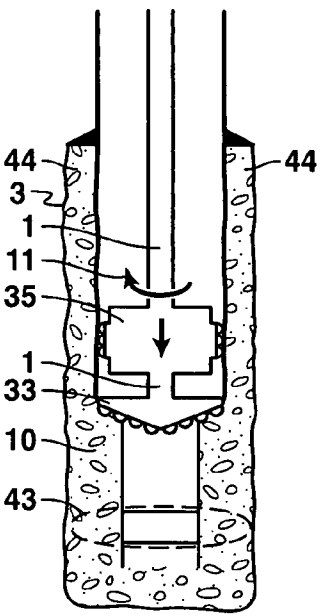
Figure 5C:
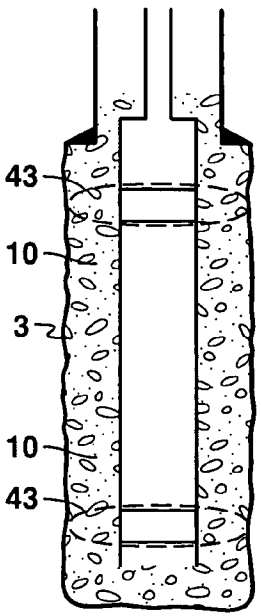
Figure 5B:
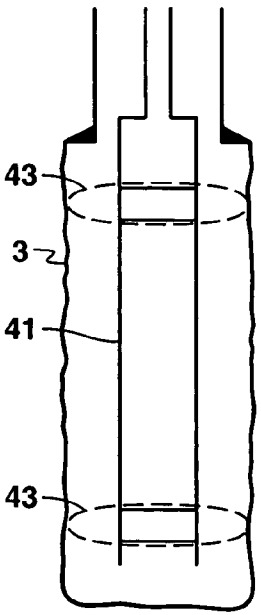
Figure 5A:
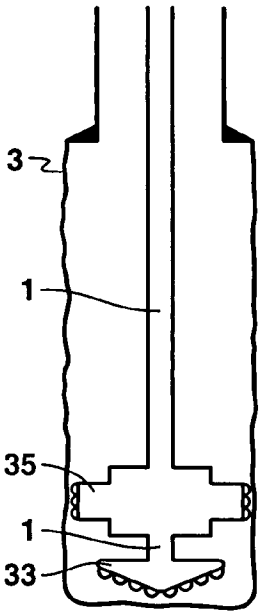

FIGS. 4(*a*), 4(*b*) and 4(*c*) illustrate graphically the second embodiment of drilling and lining the wellbore 3 using the continuos monobore cast-in-place liner drilling system. As shown in FIG. 4(*a*), in one version of this embodiment, a borehole 3 is drilled with a drill bit 33 and reamer assembly 35 attached to a drillstring 1 until hole conditions dictate that it is necessary to line or case the hole. The reamer may be any reamer, for example, a retractable reamer or in the alternative a bicenter bit may be used. These devices are used to facilitate opening the hole so that a tight-fitting casing can successfully be run into the open hole. For example, a 0.3683 meter (14 ½ inch) borehole may be reamed out to 0.508 meter (20 inch) to facilitate running 0.4064 meter (16 inch) casing below a 0.4572 meter (18 inch) casing. The retractable reamer system may be used to enable removing the bit from beneath a cast-in-place liner. The drill string may also have shearing devices 37 or stabilizers to provide stability during rotation of drill string 1. The stabilizers may provide lateral support by contacting the liner 39 or internal diameter of the well in a previously drilled or lined section.

The drill string may be equipped with a retractable reamer in the bottomhole assembly. This reamer may be used to ream a hole size that is larger than the inner diameter of the previous casing/liner. The reamer may also be used to provide centralization of the bottom of the drill string. A stabilizer (or similar device) 37 having an outer diameter slightly smaller approximately 6.35 millimeter (¼ inch) smaller) than the inner diameter of the previous casing/liner may be installed on each 27.43 meter (90 foot) stand of drill pipe over a distance of several thousand meters. The stabilizer-equipped drill string 1 may extend to at least one stand inside the previous casing/liner. The stabilizers 37 may be used to shear the settable material and centralize the drill string inside the previous section of monobore liner. In addition, it may be desirable to coat the drill string with a material that prevents sticking of the settable material Once a depth is reached where it has been determined that it is necessary to increase the mud weight beyond the fracture gradient of the current open hole to continue drilling, the cast-in-place liner job may commence. The settable material 10 may be pumped down the drill string and into the annulus using a volume that would bring the top of the material inside the previous liner. A check valve, run in the drill string, may be used to prevent any U-tubing back up the drill string if there is a density imbalance. U-tubing is the flow of a heavier fluid down the annulus and up the pipe. Alternatively, the settable material might be circulated through a remotely controlled port in a circulation tool located near the end of the drill string. Another alternative would be for the settable material to be pumped down the annulus, taking returns up the drill string. For this option, the check valve would not be used.

After the settable material 10 has been circulated into place and allowed to build some gel strength, drill string reciprocation and rotation may commence. The pipe reciprocation and rotation are indicated by the arrows (11 and 13 respectively) in FIG. 4(*b*). The amount of time to build gel strength will depend on the particular material and the conditions inside the wellbore. For example, 30 minutes would be a typical allotted time for some materials to gel or set in typical wellbores. In addition, or as an alternative to pipe reciprocation and rotation, circulation may commence down the drill string and up the core of the settable cylinder. The circulation is indicated by arrows 14 in FIG. 4(*b*). The reciprocation may preferably have a stroke of one stand of approximately 10 meters (or 90 feet). The circulating fluid may also contain a set retarder (for example, sugar water for a Portland cement based settable material). The pipe movement and/or circulation may be used to ensure that the core of the settable liner does not set, but the settable material outside the core will set because it is subjected to less mechanical shear stress, less flow stress, and less retarder.

An example of a settable material or gel material formulation includes cement slurry consisting of 860 grams of Class H oil well cement, 327 grams of fresh tap water, and 34 grams (4% by weight of cement) calcium chloride, a cement accelerator. The cement slurry may be mixed in accordance with standard practice and pumped into the wellbore. Then the drill string will preferably be reciprocated at approximately a stroke rate of one stand of approximately 10 meters over a period of 2 to 5 minutes. Furthermore, a 5 percent solution of sugar water (a cement retarder) or other retarder if needed may be occasionally pumped into the wellbore. The example above is a laboratory formulation and is not meant to be limiting. Persons skilled in the art can modify the formulation based on field criteria. For example, a different formulation may or may not contain steel, carbon or other types of fibers, a retarder, a fluid-loss additive, and different amounts of calcium chloride. All suitable settable materials, including, for example, epoxy resins, are intended to be within the scope of the invention.

Pipe movement and circulation may continue for a period of time until the settable material has gained sufficient strength that the mud weight can be increased and drilling resumed. Most likely, this period of time would take less than 48 hours, and may be significantly shorter, depending on the chemistry of the settable material and wellbore conditions. Persons skilled in the art will recognize the ability to determine the amount of time needed for particular materials to favorably set under certain conditions from laboratory testing and field work. The laboratory results can then be applied to a field wellbore. Once the settable material has hardened, the pilot bit and adjustable reamer could be used to dress the inner diameter of the settable-material liner, as needed.

As illustrated in FIG. 4(*c*), after the monobore cast-in-place liner has been created over an interval, the drilling may continue and a new section of the wellbore may be drilled if necessary. The process of drilling/reaming and creating a monobore vast-in-place liner may be repeated until the well reaches the planned total depth.

Figure 3:
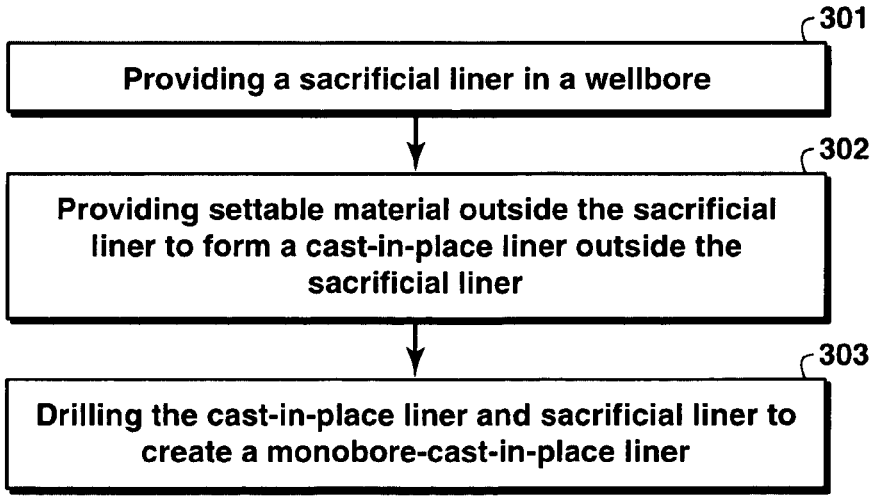
FIG. 3 is a flow chart of an embodiment of the present invention.

A third embodiment, as shown in FIG. 3 will now be discussed. In this embodiment, a sacrificial liner is provided inside the wellbore (step 301). An example of a sacrificial liner is disclosed in European Patent Application No. 1,300,545 A1. The problems with the prior art sacrificial liners includes the time and expense of running and removing the inner pipe inside the liner. This inner string also creates additional complexity and risk of trouble. We have discovered that cement can be pumped through a sacrificial liner without a pipe inside the liner. This eliminates the need for a pipe inside the liner increasing the efficiency of the process.

In one embodiment, a settable material is placed outside of the liner to form a cast-in-place liner outside the sacrificial liner (step 302). The cement may be pumped through a previously cased section into the interior of a sacrificial liner without an interior pipe and at the end o9f the sacrificial liner the cement flows into the annulus between the sacrificial liner and interior wall of the wellbore. The cast-in-place liner and sacrificial liner are drilled out and, if necessary, reamed to create a monobore cast-in-place liner (step 303). The next interval may be drilled, if required. The embodiment will be discussed in more detail below.

FIGS. 5(*a*), 5(*b*), 5(*c*), 5(*d*) and 5(*e*) are graphical illustrations of one version of this embodiment. As shown in FIG. 5(*a*), a section of wellbore 3 is drilled with a drill bit 33 and reamer assembly 35 attached to a drillstring 1 and, if necessary, reamed if a wellbore is not been previously drilled.

After the section of the wellbore is drilled, a sacrificial liner 41 is run in the wellbore. As shown in FIG. 5(*b*), the sacrificial liner, without any pipes inside the liner is preferably placed in the center of the wellbore and drillable centralizers 43 may be used to center the liner by contacting the non-cased walls of the wellbore. The liner should be an easily drillable material with a tensile strength of less than 448 Mpa (65,000 psi), more preferably less than 172 Mpa (25,000 psi) and even more preferably less than 103 Mpa (15,000 psi). However, the liner needs enough tensile strength to withstand the installation loads. Next, settable materials 10 is pumped into the wellbore 3. As shown in FIG. 5(*c*), the settable materials 10 is pumped through the sacrificial liner and sets around the sacrificial liner 41 but preferably not inside the liner.

After the settable material has set and is hardened, a core is drilled out of the cast-in-liner and the sacrificial liner leaving a monobore cast-in-place liner. FIG. 5(*d*) is an illustration of drilling out a core of the set settable material 11 and the sacrificial liner 41 from FIG. 5(*c*) creating a monobore cast-in-place liner 44. The next section may be drilled. FIG. 5(*e*) is an illustration of the drilling after a section of the monobore cast-in-liner 44 has been installed. If necessary, the drilling is continued through the next wellbore interval by continuing the drillstring 1 rotation to allow the drill bit 33 to cut and the reamer 35 to extend the wellbore 3.

For deviated (or vertical) wells, to achieve a hole in the center of the settable material, the settable material would most preferably be placed around an easily drillable, centralized, sacrificial liner. This sacrificial liner might be made of a soft material, such as aluminum or plastic. The sacrificial liner might be provided on a drill pipe and released after the settable material has been placed via standard circulation techniques. The sacrificial liner may be equipped with bow-spring centralizers to ensure that the sacrificial liner is centralized in the open hole. The bow-spring centralizers would preferably be made of an easily drillable material such as plastic or aluminum. A set retarder may optionally be circulated around the liner to help soften the settable material within the core.

One purpose for the centralized sacrificial liner is to help guide the bit when the core of the settable material is drilled out because drill bits usually drill in the direction of the softest material. This will help ensure a relatively uniform wall thickness of the settable-material liner (such as, the hole in the sacrificial liner). While the sacrificial liner method requires some additional tripping of the drill string, the method avoids tapering of the borehole inner diameter. As discussed above, this is desirable for both exploration and development wells. Furthermore, the cost of lining the borehole should still be less than the alternatives. This is because the material costs will be lower (no steel casing required) and drill pipe can be tripped much faster than a casing or liner.

The resulting borehole liner from any of the above embodiments does not require running any additional steel liner or casing strings, including steel liners requiring expansion. As a result, this lining method can line the borehole much more rapidly and at much less cost than preexisting methods. Secondly, the borehole liner system disclosed herein may yield a true monobore (constant inner diameter) wellbore and does not rely on threaded connections that must be expanded and thus are subject to leakage and capacity reductions. Furthermore, the proposed solution can much more readily accommodate imperfections in borehole quality as compared to other alternatives such as the solid expandable liners.

In addition, this liner does not require altering the pressure profile of the drilling fluid to meet the earth's pore and fracture gradients. Rather, by providing a solid borehole lining, the proposed method allows the fracture gradient to be increased based on the burst capacity of the settable material (backed up by the formation strength). Also, the proposed solution does not require high velocity injection of cement into the surrounding soil or rotation of a tool to create a centrifugal force on a soil-cement mixture.

Wellbores that utilize this method may be used to produce naturally occurring hydrocarbons (such as, crude oil, natural gas, and associated fluids). Produced hydrocarbons may then be transported by, for example, pipeline, transport ship, or barge and then moved to a refinery. The oil and gas may then be refined into usable petroleum products such as, for example, natural gas, liquefied petroleum gas, gasoline, jet fuel, diesel fuel, heating oil or other petroleum products. The method is also applicable to water, gas, or other types of injection wells.

What is claimed is:

1. A method of creating a casing in a borehole with an interior wall located in a subterranean formation, comprising:

(a) drilling a borehole with a drill bit on a drill string;

(b) placing settable material into an annulus within the borehole to a desired fill height wherein the settable material sets on at least a portion of the interior wall of the borehole to create a liner along the at least the portion of the interior wall of the borehole;

(c) moving the drill string to prevent the settable material from completely plugging the borehole;

(d) circulating drilling mud containing a set retarder to remove the unset settable material near the drill string; and (e) repeating steps (c) and (d) until the lining has hardened.

2. A method of creating a casing in a borehole with an interior wall located in a subterranean formation, comprising:

(a) drilling a borehole with a drill bit on a drill string;

(b) placing settable material into an annulus within the borehole to a desired fill height wherein the settable material sets on at least a portion of the interior wall of the borehole to create a liner along the at least the portion of the interior wall of the borehole;

(c) moving the drill string to prevent the settable material from completely pluaaine the borehole;

(d) circulating drilling mud containing a set retarder to remove the unset settable material near the drill string; and (e) repeating steps (a) through (ci) until the borehole has been drilled to the desired distance with a cast-in-place liner.

3. A method of creating a casing in a borehole with an interior wall located in a subterranean formation, comprising:

(a) drilling a borehole with a drill bit on a drill string;

(b) placing settable material into an annulus within the borehole to a desired fill height wherein the settable material sets on at least a portion of the interior wall of the borehole to create a liner along the at least the portion of the interior wall of the borehole;

(c) moving the drill string to prevent the settable material from completely plugging the borehole;

(d) circulating drilling mud containing a set retarder to remove the unset settable material near the drill string; and (e) continuing drilling the borehole with a drill bit on a drill string after the unset settable material has been removed.

4. The method of claim 3 further comprising reaming the borehole as the borehole is being drilled.

5. The method of claim 3 further comprising producing hydrocarbons from the borehole.

* * * * *